US005356305A

United States Patent [19]

Riddle

[11] Patent Number: 5,356,305

[45] Date of Patent: Oct. 18, 1994

[54] ELECTRICAL CONNECTOR ASSEMBLY WITH JACKSCREW COUPLING

[75] Inventor: Douglas E. Riddle, Corona, Calif.

[73] Assignee: Hughes Aircraft Company, Los Angeles, Calif.

[21] Appl. No.: 44,666

[22] Filed: Apr. 9, 1993

[51] Int. Cl.[5] ..... H01R 13/627

[52] U.S. Cl. ..... 439/364; 439/701

[58] Field of Search ..... 439/359, 361, 363, 364, 439/365, 378, 681, 701

[56] References Cited

U.S. PATENT DOCUMENTS

| | | | |
|---|---|---|---|
| 3,281,761 | 10/1965 | Moulin . | |
| 3,771,108 | 11/1973 | Haffner et al. | 439/364 X |
| 3,853,381 | 12/1974 | Morningstar | 439/364 |
| 4,361,374 | 11/1982 | Marmillion et al. . | |
| 4,383,964 | 5/1983 | Prus | 264/237 |
| 4,627,759 | 12/1986 | Kato et al. | 403/2 |
| 4,726,791 | 2/1988 | Rudy, Jr. et al. | 439/677 |
| 4,820,204 | 4/1989 | Batty | 439/681 |
| 4,927,374 | 5/1990 | Batty | 439/310 |
| 4,934,950 | 6/1990 | Green et al. | 439/681 |
| 4,969,842 | 11/1990 | Davis | 439/629 |
| 5,037,332 | 8/1991 | Wilson | 439/608 |
| 5,046,967 | 9/1991 | Majernik et al. | 439/610 |
| 5,217,386 | 6/1993 | Ohsumi et al. | 439/364 |

*Primary Examiner*—Khiem Nguyen
*Attorney, Agent, or Firm*—Elizabeth E. Leitereg; T. Gudmestad; W. K. Denson-Low

[57] ABSTRACT

An electrical connector assembly includes two connector blocks that are coupled together by means of a jackscrew on one block that is screwed into a receiver on the other block. The jackscrew and receiver are formed from metal, while the remainder of the connector blocks are formed from a lower cost and lighter weight plastic. The receiver is held in place within a securing member in the second connector block, with the receiver and securing member having complimentary outer and inner polygon surfaces to keep the receiver from rotating. Axial receiver movement is prevented by a boss on the securing member that extends into a recess in the receiver, while the securing member is held against axial movement between a flange on one side and a securing cap on the other. The jackscrew is rotatably secured to the first connector block within a retainer that is held in place by sandwiching a portion of the connector block between a retainer flange and a securing cap that screws on over a threaded portion of the receiver. The jackscrew in turn has a flange that is lodged between the retainer and the cap to secure it against axial movement, while leaving it free to rotate.

20 Claims, 2 Drawing Sheets

ELECTRICAL CONNECTOR ASSEMBLY WITH JACKSCREW COUPLING

BACKGROUND OF THE INVENTION

1. Field of the Invention

This invention relates to electrical connector assemblies in which multiple electrical connections are made between two connector blocks when the blocks are brought together, and more particularly to such assemblies that employ a jackscrew to bring the two blocks together in mutual alignment.

2. Description of the Related Art

Electrical connector assemblies are widely employed when relatively large numbers of electrical connections are to be made at the same time. The assemblies typically employ a pair of connector blocks, one with an array of male contacts and the other with a matching array of mating female contacts. Each male contact extends into a corresponding female contact when the two blocks are brought together, thereby establishing the desired pattern of electrical connections. Of course, it is important that the connector blocks be properly aligned with each other during the assembly process.

A connector assembly is described in U.S. Pat. No. 3,281,761 to Moulin, assigned to Hughes Aircraft Company, the assignee of the present invention, which automatically aligns the two connector blocks with each other as they are brought together. This is accomplished with a jackscrew coupling in which a jackscrew on one of the blocks screws into a threaded receptacle on the other block, drawing the two blocks together as the jackscrew is progressively screwed in. An alignment between the two blocks is achieved by means of keying sections or tines that extend from the two blocks towards each other around the outside of the jackscrew. The tines from each block are separated by notches into which the tines from the opposite block can be inserted. The tines and notches are made non-symmetrical, permitting the two blocks to be fully assembled only when they are properly aligned; in other orientations the two sets of tines hit each other, preventing further rotation of the jackscrew to bring the blocks together.

While the connector assembly described in the '761 patent represents a distinct improvement, it still has some serious limitations. Its various parts are made of metal to withstand the axial forces imposed by the rotation of the jackscrew into the threaded receiver on the other block. Metal parts, however, add significantly to the device's cost and weight, and require very close machining tolerances. Furthermore, the mechanism for securing the jackscrew to the first connector block involves crimping a portion of an annular collar around a flange on the jackscrew. This is a cumbersome operation, and can result in interference with the jackscrew rotation if the crimp is too tight, or a possibility of the jackscrew coming out if the crimp is too loose.

Other electrical connector assemblies that employ jackscrews to bring together a pair of connector blocks are described in U.S. Pat. No. 4,934,950 to Green et al., and U.S. Pat. No. 4,627,759 to Kato et al. In the '950 patent a jackscrew nut is mounted over the rear portion of a jackscrew in a male connector block, and held in place by a roll pin that is inserted in an interference fit through aligned holes in the pin and jackscrew. The nut is slotted so that it can be rotated by a screwdriver to rotate the jackscrew. The jackscrew, however, does not project into the opposite connector block. Rather, a free standing key member on that block includes a threaded interior opening that engages the jackscrew threads, with the key member drawn into a keyed opening surrounding the jackscrew in the first connector block as the screw is rotated. Furthermore, the various parts are made of metal, with the attendant cost and weight drawbacks discussed above. In the '759 patent a taper is cut into the middle portion of the jackscrew, which is held in place on its connector block between a conventional screw head and a stopper that is retained in the tapered portion. The jackscrew is thus intentionally weakened, so that it breaks before either the connector housing or the jackscrew threads are damaged in case of over-tightening. The jackscrew is required to be first inserted into the connector block from the rear, and the stopper then put in place over the tapered portion of the screw shaft. This operation is made difficult by the presence of a chamber which surrounds the front end of the jackscrew for the purpose of receiving a nut on the opposite connector block, which receives the jackscrew.

SUMMARY OF THE INVENTION

The present invention seeks to provide an improved jackscrew operated electrical connector assembly that can be constructed primarily from a plastic that is lighter and much less expensive than the metal parts used heretofore, yet retains metallic strength for the jackscrew coupling, and that requires an assembly process that is simple and does not risk interfering with the later operation of the jackscrew.

These goals are accomplished by providing a jackscrew that is rotatably retained within one connector block, and a threaded metal receiver in a second connector block that receives the threaded end of the jackscrew to bring the two connector blocks together. The receiver has an outer polygon shape and is lodged within an opening in a plastic portion of the second connector block; the opening has a matching polygon shape and provides a bearing surface that inhibits rotation of the receiver. An alignment mechanism is also provided to assure a proper mating between the respective electrical connectors of the two blocks when they are brought together.

The second connector block preferably includes a plastic securing member that is secured against rotation, with the polygon-shaped opening for the metal receiver provided in the securing member. The corners of the receiver are rounded, generally along a radius of the receiver, to distribute a turning moment from the receiver along the bearing surface. The receiver is held against axial movement by means of a recess formed between its opposite ends, into which a boss from its connector block extends. Both of the connector blocks are preferably formed from plastic.

The jackscrew is held in place with the assistance of a retainer in the first block. A securing cap is threaded onto the retainer, and includes an opening which provides access to the jackscrew. The jackscrew includes a flange that is lodged between opposed bearing surfaces on the retainer and securing cap, preventing it from dislodging. The retainer itself includes a peripheral flange that is located forward of its bearing surface, with the retainer flange and the securing cap sandwiching a portion of the first connector block between them to hold the retainer in place. The retainer flange has a polygon shape and is lodged in a recess in the first connector block that has a complimentary polygon shape to prevent the retainer from rotating.

The result is a connector assembly that is strong yet light in weight, and easy to assemble. These and other features and advantages of the invention will be apparent to those skilled in the art from the following detailed description, taken together with the accompanying drawings.

DETAILED DESCRIPTION OF THE INVENTION

Figure 1:
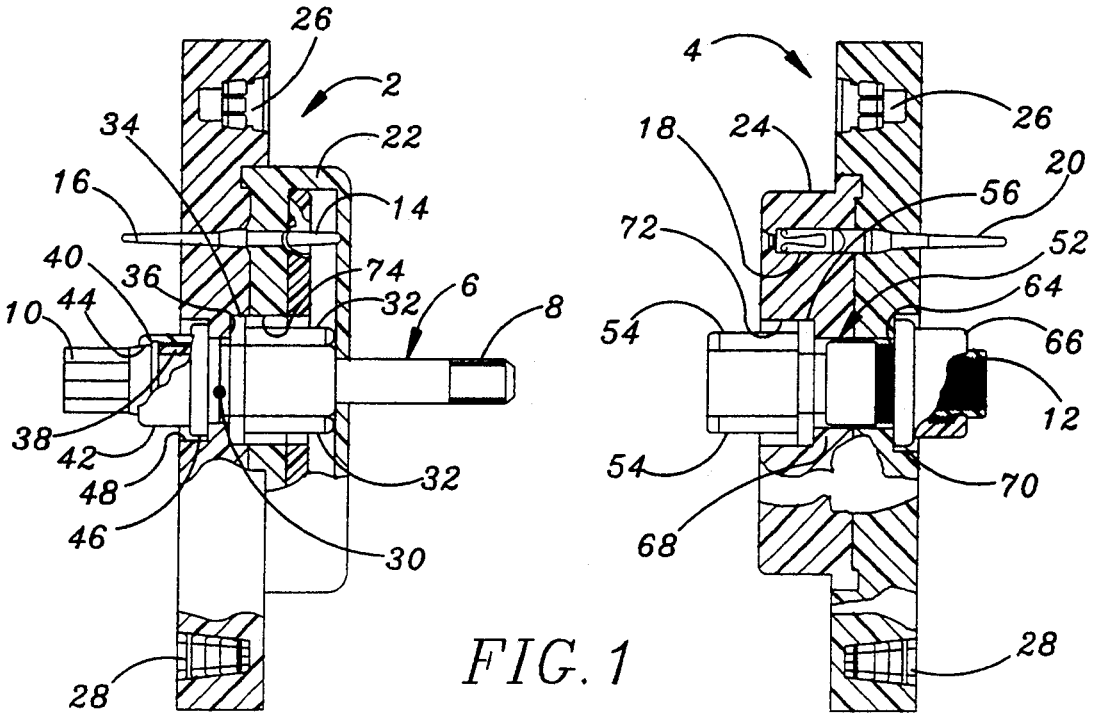
FIG. 1 is a partially sectioned elevation view of the two connector blocks employed in the electrical connector assembly of the invention.
Figure 2:
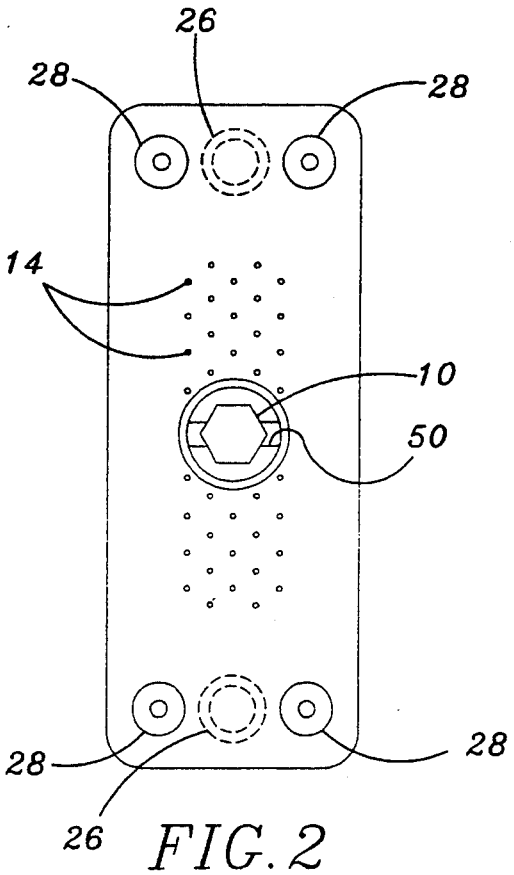
FIGS. 2 and 3 are respectively left and right hand elevation views of the assembly shown in FIG. 1.
Figure 3:
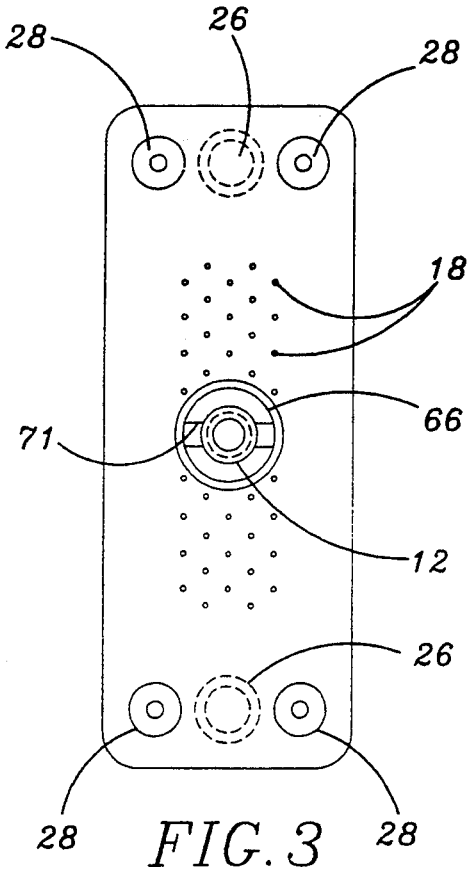

An electrical connector assembly that provides as sure a connection as in previous designs such as that described in U.S. Pat. No. 3,281,761, but with a significantly lower cost, a simpler structure, less rigid tolerance requirements and less weight, is shown in FIGS. 1–3. The connector assembly includes a male connector block 2 and a female connector block 4 that are brought together to establish the desired electrical connections. The connector blocks are preferably formed from a strong but light weight plastic, such as VALOX® 420SEO by General Electric Company. The male connector block 2 includes a jackscrew 6 having a threaded forward end 8, and a rear end 10 with a hexagonal outer circumference for receiving a wrench to rotate the jackscrew about its axis. The jackscrew's threaded end 8 fits into an interior threaded receiver 12 that is held in the female block 4. With the jackscrew threads 8 engaging the interior threading in the receiver 12, a clockwise rotation of the jackscrew draws the male and female connector blocks together until the desired electrical connections are made.

The male connector block 2 includes an array of forward extending male pins 14 to which electrical signals are applied through respective wires 16, while the female connector block 4 includes a complimentary array of electrical sockets 18 into which the pins 14 are inserted when the two blocks are assembled together. The pins 14 and sockets 18 are of conventional design, with each socket including an input/output wire 20. Insertion of the pins into their corresponding sockets completes an electrical connection between their respective signal wires 18 and 20. An array of 38 pins and sockets is illustrated in FIGS. 2 and 3, but any desired number could be provided. A protective flange 22 extends around the array of pins 14, while the sockets 18 are set in a protuberance 24 from the female connector block 4, with flange 22 surrounding the protuberance 24 when the two connector blocks are brought together.

Each of the connector block also includes a centered threaded insert 26 at their top and bottom ends for mounting the block to a panel, if desired. Pairs of threaded inserts 28 are also provided at the top and bottom ends of the connector blocks for securing wire cables from which the individual wires 16 and 20 extend.

The jackscrew 8 is secured to the male connector block 2 with a mechanism that is simpler than that used in the past, requires fewer parts, yet securely holds the jackscrew in place while permitting it to be easily coupled with the other connector block. A retainer 30 extends through a central opening in the male connector block. A series of forward directed tines 32 are provided around its periphery at the forward end of the retainer to ensure that the two connector blocks are properly aligned with each other before they are brought together by the jackscrew, as described below. The tines 32 extend forward from a flange 34 on the retainer that bears against a boss 36 on the block, preventing the retainer from shifting to the left from its position shown in FIG. 1. The rear end of the retainer is an outside threaded cylinder 38 of reduced diameter that extends out to the left from the connector block. The jackscrew shaft extends through a central bore in the retainer 30 and includes a flange 40 that bears against the retainer's rear surface, thus limiting the jackscrew's movement to the right as shown in FIG. 1.

To secure the jackscrew in position on the connector block 2, a cap 42 with an annular threaded interior wall is screwed on over the rearward threaded extension 38 of the retainer 30. An opening is provided in the cap's rear wall through which the jackscrew's hexagonal gripping portion 10 extends, allowing the jackscrew to be easily accessed for rotation when the securing cap 42 is in place. The cap's rear wall includes an annular lip 44 that extends radially inward almost to the periphery of the jackscrew, and abuts against the rear surface of the jackscrew flange 40 when the cap has been screwed on over the threaded retainer cylinder 38. A forward flange 46 on the cap lodges in a central recess 48 in the rear of the connector block, bearing against the opposite side of boss 36 from the retainer flange 34 when the cap has been screwed on. Thus, the retainer 30 is securely held in place within the connector block 2 by screwing the cap 42 onto the end of the retainer, so that the connector block boss 36 is sandwiched between the retainer flange 34 and the cap flange 46. The jackscrew in turn is held in place by sandwiching its flange 40 between the rear of the retainer and the lip 44 on the securing cap. With the cap fully screwed on over the retainer, a slight clearance is preferably left between the lip 44 and jackscrew flange 40 to facilitate easy rotation of the jackscrew. A slot 50 in the cap's rear surface surrounding the jackscrew allows the cap to be tightened in place with a spanner wrench.

Figure 4:
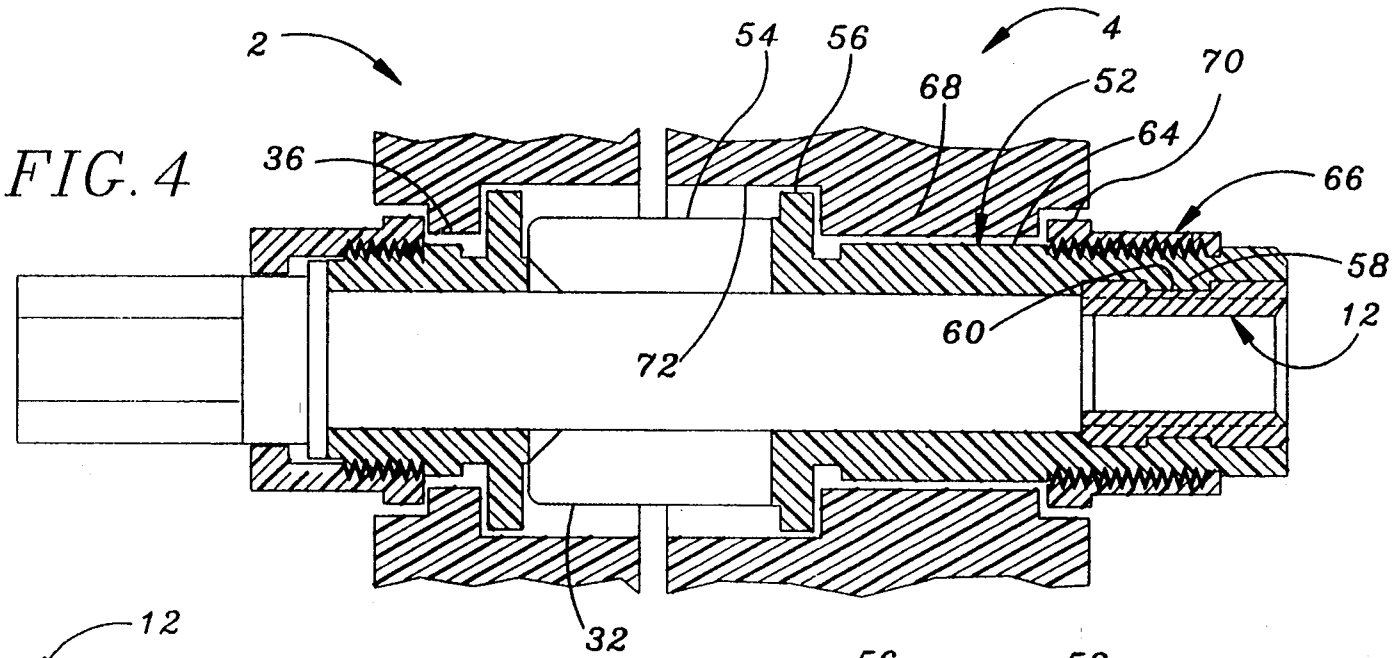
FIG. 4 is an enlarged sectional view of the coupling mechanism for the two connector blocks, with the blocks assembled together.
Figure 5:
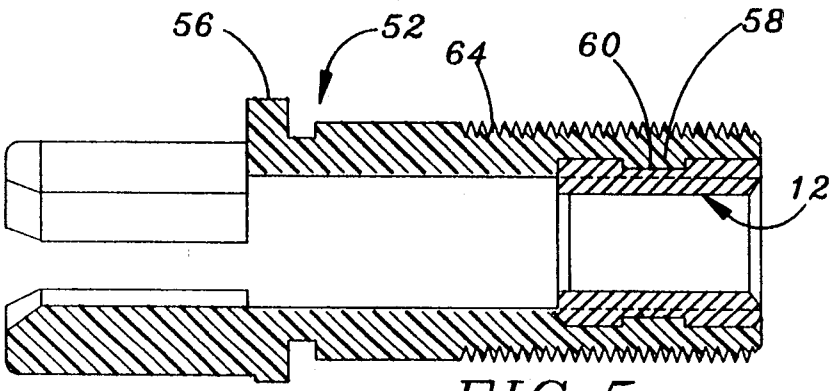
FIG. 5 is a sectional view of the receiver mechanism used in one of the connector blocks for coupling with a jackscrew from the other block.

The mechanism on the female connector block 4 that receives the jackscrew is shown in FIGS. 1 and 4, with the male and female connector blocks assembled together in FIG. 4. Both the jackscrew 6 and the receiver 12 are preferably formed from a strong metal, such as anodized aluminum or passivated stainless steel, that is capable of withstanding the high stresses imparted to their complimentary threads when the connector blocks are screwed together. The receiver 12 is formed as an insert in a securing member 52, which in turn is lodged within a central opening through the female connector block 4; the securing member 52 and receiver 12 are shown in isolation in FIG. 5. The forward (left) end of the securing member 52 has a plurality of tines 54 that extend forward from a securing member flange 56 in a complimentary arrangement to the tines 32 from the male connector block. The two sets of tines mate together, in a manner similar to that described in U.S. Pat. No. 3,281,61, to assure a proper rotational alignment between the two connector blocks when they are brought together. Each set of tines fits closely into the spaces between the tines of the other set when the connector blocks are properly aligned, allowing the blocks to be brought together. If the blocks are not properly aligned, the opposed tines hit each other and prevent the blocks from being brought together. The forward ends of the tines are preferably chamfered to facilitate their proper alignment.

Figure 6:
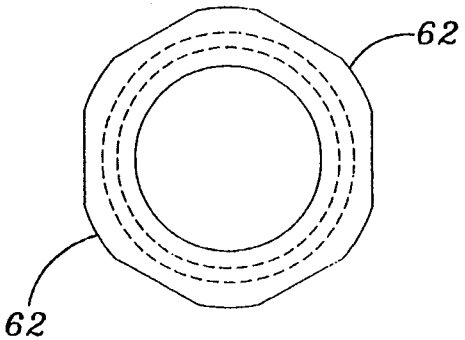
FIG. 6 is a side elevation view of the receiver insert shown in FIG. 5.

Both the securing member 52 and the retainer 30 are preferably formed from a strong but light weight plastic, such as ULTEM® 2300 from General Electric Company. Thus, the receiver 12 is the only metal portion of the female connector block (aside from the metallic electrical contacts in the sockets 18), thereby minimizing the amount of metal and high precision machining that would otherwise be required. The receiver 12 is held firmly against axial movement by an inward directed boss 58 that extends into a peripheral recess 60 around the central portion of the receiver's outer surface. This is most conveniently accomplished by first fabricating the receiver as a separate piece, and then molding the securing member 52 around the receiver. To prevent any rotational movement of the receiver within the securing member, the outer receiver surface has a polygon shape, preferably a hexagon, as shown in FIG. 6. The receiver's outer corners 62 are preferably rounded along a radius extending from the center of the receiver, thereby better distributing the rotational stress from the receiver to the adjacent walls of its securing member when the jackscrew is tightened. This helps to prevent any rotational movement of the receiver relative to the somewhat softer plastic material of the securing member. A tight fit between the receiver and the surrounding securing member is assured by the molding process used to fabricate the securing member with the receiver in place.

The rear portion of the receiver has an outside threading 64 that receives an inside threaded securing cap 66. An inward directed boss 68 in the female connector block is sandwiched between a flange 70 at the forward end of the cap and the securing member flange 56, thus holding the securing member firmly against axial movement when the cap is tightened. A spanner wrench slot 71 is preferably provided at the rear of cap 66.

Figure 7:
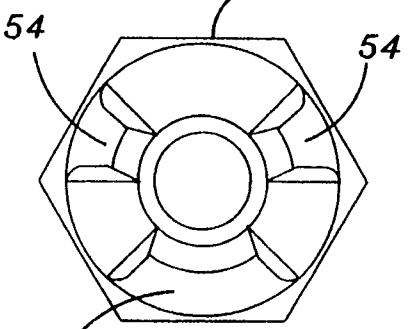
FIG. 7 is a left side elevation view of the receiver assembly shown in FIG. 5.

The arrangement of the alignment tines 54 for the female connector block 4 is shown in the left side elevation view of FIG. 7. It can be seen that the tines are non-symmetrically arranged around the securing member 52. Providing the tines 32 from the retainer 30 in the male connector block 2 with a complimentary asymmetry assures a proper alignment between the two blocks. It can also be seen in FIG. 7 that the securing member flange 56 has a polygon shape, preferably hexagonal. The recess 72 in the female connector block within which the securing member flange lodges has a mating hexagonal shape, causing the walls of the recess to bear against the outer surface of securing member flange 56 to prevent the securing member from rotating. Similarly, the retainer flange 34 has an outer hexagonal shape and is lodged within a recess 74 in the male connector block that has a matching hexagonal shape, thus preventing the jackscrew retainer from rotating.

In operation, the male connector block is assembled by inserting the retainer 30 into the recess 74 from the right (as seen in FIG. 1), inserting the jackscrew through the central retainer opening from the left, and then screwing on the cap 40 over the threaded portion of the retainer. The female connector block is assembled by inserting the securing member 52 through the recess 72 from the left, and simply tightening the cap 66 over the securing member threads 64. The two connector blocks are then brought together, with the jackscrew 6 extending through the central opening in the securing member 52 and into the receiver 12. The jackscrew is rotated about its axis, using a wrench if desired, to progressively screw it into the receiver, thus drawing the two connector blocks together so that the pins 14 mate with their corresponding sockets 18 and establish secure electrical connections. Proper alignment between the two connector blocks is assured during this process by the coupling between the two sets of tines 32 and 54. The metal jackscrew and receiver are strong enough to withstand the forces produced during the progressive tightening of the jackscrew, while the main bulk of the assembly is implemented with the lower cost plastic.

While a particular embodiment of the invention has been shown and described, numerous variations and alternate embodiments will occur those skilled in the art. Accordingly, it is intended that the invention be limited only in terms of the appended claims.

I claim:

1. An electrical connector assembly, comprising:

first and second connector blocks having multiple mating electrical connectors that mutually connect when the connector blocks are assembled, a metal jackscrew that is threaded at one end, means for rotatably retaining said jackscrew in said first connector block with its threaded end protruding, a threaded metal receiver in said second connector block to which the threaded end of the jackscrew is screwed to bring said connector blocks together in an assembly, said receiver having an outer polygon shape and lodged in an opening within a plastic portion of said second connector block that has a matching polygon shape, said opening providing a bearing surface to inhibit rotation of the receiver, said second connector block including a plastic securing member that is secured against rotation in said second connector block, with said polygon-shaped opening provided in said securing member, and means for aligning said connector blocks so that their respective electrical connectors come into contact with each other when the jackscrew is screwed to the receiver.

2. The electrical connector assembly of claim 1, wherein the corners of said receiver are rounded to distribute a turning moment from said receiver along the bearing surface provided by said plastic portion of the second connector block.

3. The electrical connector assembly of claim 2, wherein the corners of the receiver's outer polygon shape are rounded generally along a radius of the receiver.

4. The electrical connector assembly of claim 1, said receiver having a regular hexagonal outer shape.

5. The electrical connector assembly of claim 1, said plastic portion of the second connector block including a boss that projects into said opening, and said receiver including a recess between its opposite ends into which said boss extends to restrain the receiver from axial movement.

6. The electrical connector assembly of claim 1, wherein said connector blocks are formed from plastic.

7. An electrical connector assembly, comprising:

first and second connector blocks having multiple mating electrical connectors that mutually connect when the connector blocks are assembled, a jackscrew that is threaded at one end and has an engagement element towards its other end for receiving a rotational movement, a retainer in said first connector block having an internal opening through which said jackscrew extends between opposite sides of said first connector block, a threaded receiver in said second connector block to which the threaded end of the jackscrew is screwed to bring said connector blocks together in an assembly, means for aligning said connector blocks so that their respective electrical connectors come into contact with each other when the connector blocks are brought together, a securing cap that is threaded onto said retainer to secure the jackscrew therein, said securing cap including an opening to permit access to the jackscrew's engagement element so that the jackscrew can be rotated and screwed into said receiver member, and a stop for limiting the amount said securing cap can be threaded onto said retainer, said retainer and securing cap including respective rearward and forward facing bearing surfaces, said jackscrew including a flange that is lodged between said bearing surfaces when said securing cap is threaded onto said retainer, thereby securing the jackscrew in place on the first connector block, and said stop limiting the threading of said securing cap onto said retainer to leave clearance for rotating the jackscrew.

8. The electrical connector assembly of claim 7, said aligning means comprising a first shaped member extending forward from said retainer, and a second shaped member that is shaped complementarily to said first shaped member and extends from said second connector block to mate with said first shaped member when the two blocks are brought together in proper alignment, said shaped members inhibiting said blocks from being brought together when they are out of alignment.

9. An electrical connector assembly, comprising:

first and second connector blocks having multiple mating electrical connectors that mutually connect when the connector blocks are assembled, a jackscrew that is threaded atone end and has an engagement element towards its other end for receiving a rotational movement, a retainer in said first connector block having an internal opening through which said jackscrew extends between opposite sides of said first connector block, a threaded receiver in said second connector block to which the threaded end of the jackscrew is screwed to bring said connector blocks together in an assembly, means for aligning said connector blocks so that their respective electrical connectors come into contact with each other when the connector blocks are brought together, and a securing cap that is threaded onto said retainer to secure the jackscrew therein, said securing cap including an opening to permit access to the jackscrew's engagement element so that the jackscrew can be rotated and screwed into said receiver member, said retainer and securing cap including respective rearward and forward facing bearing surfaces, and said jackscrew including a flange that is lodged between said bearing surfaces when said securing cap is threaded onto said retainer, thereby rotatably securing the jackscrew in place on the first connector block, said aligning means comprising a first shaped member extending forward from said retainer, and a second shaped member that is shaped complementarily to said first shaped member and extends from said second connector block to mate with said first shaped member when the two blocks are brought together in proper alignment, said shaped members inhibiting said blocks from being brought together when they are out of alignment, said retainer including a peripheral flange located forward of its rearward facing bearing surface, said retainer flange and securing cap sandwiching at least a portion of the first connection block between them to hold the retainer on the first connector block.

10. The electrical connector assembly of claim 9, said retainer flange having a polygon shape, and being lodged in a recess in the first connector block that has a complementary polygon shape to prevent relative rotation between the retainer and the first connector block.

11. The electrical connector assembly of claim 7, wherein said jackscrew is formed from metal, and further comprising a plastic securing member held against rotation in said second connector block, said receiver being formed from metal and secured against rotation within said securing member.

12. The electrical connector assembly of claim 11, said receiver having an outer polygon shape and said securing member having a complementary polygon opening within which the receiver is lodged, with the outer receiver surface bearing against the walls of said securing member opening to prevent the receiver from rotating.

13. The electrical connector assembly of claim 12, wherein the corners of the receiver's outer polygon shape are rounded to distribute a turning moment from said receiver along the walls of the opening in said securing member.

14. The electrical connector assembly of claim 13, wherein the corners of the receiver's outer polygon shape are rounded generally along a radius of the receiver.

15. The electrical connector assembly of claim 12, said receiver having a regular hexagonal outer shape.

16. The electrical connector assembly of claim 11, said aligning means comprising a first shaped member that extends from said first connector block, and a second shaped member that is shaped complementarily to said first shaped member and extends from said securing member to mate with said first shaped member when the two blocks are brought together in proper alignment, said shaped members inhibiting said blocks from being brought together when they are out of alignment, said securing member including a peripheral flange that has a polygon shape and is lodged in a recess in the second connector block, said recess having a complementary polygon shape to prevent relative rotation between the securing member and the second connector block.

17. An electrical connector assembly, comprising:

first and second connector blocks having multiple mating electrical connectors that mutually connect when the connector blocks are assembled, a metal jackscrew that is threaded at one end and has an engagement element towards its other end for receiving a rotational movement, a retainer in said first connector block having an internal opening through which said jackscrew extends between opposite sides of said first connector block, a threaded receiver in said second connector block to which the threaded end of the jackscrew is screwed to being said connector blocks together in an assembly, a plastic securing member held against rotation in said second connector block, said receiver being formed from metal and secured against rotation within said securing member, means for aligning said connector blocks so that their respective electrical connectors come into contact with each other when the connector blocks are brought together, said aligning means comprising a first shaped member that extends from said first connector block, and a second shaped member that is shaped complementarily to said first shaped member and extends from said securing member to mate with said first shaped member when the two blocks are brought together in proper alignment, said shaped members inhibiting said blocks from being brought together when they are out of alignment, said securing member including a peripheral flange that has a polygon shape and is lodged in a recess in the second connector block, said recess having a complementary polygon shape to prevent relative rotation between the securing member and the second connector block, said recess facing forward towards the first connector block, a first securing cap that is threaded onto said retainer to secure the jackscrew therein, said first securing cap including an opening to permit access to the jackscrew's engagement element so that the jackscrew can be rotated and screwed into said receiver member, and a second securing cap that screws onto the rear portion of said securing member to hold the securing member in place by sandwiching at least a portion of said second connector block between said securing member flange and said securing cap.

18. The electrical connector assembly of claim 11, wherein said connector blocks are formed from plastic.

19. An electrical connector assembly, comprising:

first and second connector blocks having multiple mating electrical connectors that mutually connect when the connector blocks are assembled, a jackscrew that is threaded at one end and has an engagement element towards its other end for receiving a rotational movement, a retainer in said first connector block having an internal opening through which said jackscrew extends between opposite sides of said first connector block, a threaded receiver in said second connector block to which the threaded end of the jackscrew is screwed to bring said connector blocks together in an assembly, means for aligning said connector blocks so that their respective electrical connectors come into contact with each other when the connector blocks are brought together, and a securing cap that is threaded onto said retainer to secure the jackscrew therein, said securing cap including an opening to permit access to the jackscrew's engagement element so that the jackscrew can be rotated and screwed into said receiver member, said retainer including a peripheral flange located forward of its rearward facing bearing surface, said retainer flange and securing cap sandwiching at least a portion of the first connection block between them to hold the retainer on the first connector block.

20. The electrical connector assembly of claim 19, said retainer flange having a polygon shape, and being lodged in a recess in the first connector block that has a complementary polygon shape to prevent relative rotation between the retainer and the first connector block.

* * * * *